US006864439B2

(12) United States Patent
Chen

(10) Patent No.: US 6,864,439 B2
(45) Date of Patent: Mar. 8, 2005

(54) SWITCH FOR CONTROLLING A RANGE OF MOVEMENT

(75) Inventor: Shaodong Chen, Suzhou (CN)

(73) Assignee: Positec Power Tools (Suzhou) Co. Ltd., Suzhou (CN)

( * ) Notice: Subject to any disclaimer, the term of this patent is extended or adjusted under 35 U.S.C. 154(b) by 0 days.

(21) Appl. No.: 10/659,769

(22) Filed: Sep. 10, 2003

(65) Prior Publication Data

US 2004/0124072 A1 Jul. 1, 2004

(30) Foreign Application Priority Data

Sep. 10, 2002 (CN) ..... 2264324

(51) Int. Cl.[7] ..... H01H 19/20

(52) U.S. Cl. ..... 200/6 BB; 200/500; 200/501; 200/568; 200/569; 200/47

(58) Field of Search ..... 200/33 B–33 D, 200/568, 569, 572, 11 R, 11 G, 16 R, 16 C, 500, 501, 573, 574, 47, 336

(56) References Cited

U.S. PATENT DOCUMENTS 2,960,580 A * 11/1960 Aquillon ..... 200/6 BB
3,299,225 A * 1/1967 Willans ..... 200/6 B
3,971,904 A * 7/1976 Ward ..... 200/6 BB
4,103,132 A * 7/1978 Schwarzkopf ..... 200/568
4,147,073 A 4/1979 Mercier
4,334,132 A * 6/1982 Poole ..... 200/566
4,803,313 A * 2/1989 Rolf ..... 200/6 BB
5,299,678 A 4/1994 Chang et al.

* cited by examiner

*Primary Examiner*—Michael A. Friedhofer
(74) *Attorney, Agent, or Firm*—Harness, Dickey & Pierce, P.L.C.

(57) ABSTRACT

A switch for limiting and controlling a linear range of movement by rotational means. Two limiting positions of the switch are independently adjusted using worm gears. The switch includes a plate and a rotatable block having a rotatable shaft rotatably disposed relative to the plate. The plate has first and second electrolinking points spaced apart from each other. One end of a spring plate is fixed to the first electrolinking point, a middle portion of the spring plate is abutted against a circumferential edge of the rotatable block and the other end of the spring plate adopts two working positions with respect to the second electrolinking point.

12 Claims, 4 Drawing Sheets

A 2 – A 2

SWITCH FOR CONTROLLING A RANGE OF MOVEMENT

FIELD OF THE INVENTION

The present invention relates to a switch for controlling the range of movement of (for example) a garage door.

BACKGROUND OF THE INVENTION

U.S. Pat. No. 4,147,073 discloses a reversible motor that drives a main screw to rotate reversibly and drive a nut slider to move axially. The slider is connected to a garage door. A second screw is coaxially connected to the main screw and the screw-pitch thereof is small. The switch actuator on the second screw only moves axially to make the garage door move up and down (ie open and close).

U.S. Pat. No. 5,299,678 discloses an adjustable limit switch mechanism to control the operation of the electric motor of a garage door opener to make the garage door move in a selected range. The switch mechanism comprises a screw driven by the electric motor and at least one switch actuator disposed on the screw which is adjustably positionable. When the screw rotates, the switch actuator does not rotate with the screw and moves only axially. A limit switch is adjacent to the screw so that when the screw rotates, the switch actuator moves axially on the screw to actuate the limit switch thereby causing the motor to operate or stop. These two switch mechanisms are remotely disposed at the respective ends of the screw so that the range of movement is difficult to adjust. Furthermore, the two switch mechanisms are linear and cannot directly control the range of movement of the screw.

SUMMARY OF THE INVENTION

The object of the present invention is to provide a switch which may directly control a linear range of movement rotationally.

In accordance with the present invention, there is provided a switch for controlling a range of movement which comprises a plate and a rotatable block. A rotatable shaft is fixed at a central axis of the rotatable block and is rotatably disposed relative to the plate. The plate fixes a first electrolinking point and a second electrolinking point which are spaced apart from each other by a certain distance. One end of a spring plate is fixed to the first electrolinking point, a middle portion of the spring plate is abutted against a circumferential edge of the rotatable block and the other end of the spring plate adopts two working positions with respect to the second electrolinking point. In one working position, the other end of the spring plate contacts the second electrolinking point and in the other working position, the other end of the spring plate is disconnected from the second electrolinking point. The circumferential edge of the rotatable block forms a radial projection or hollow. As the middle portion of the spring plate moves in and out of contact with the radial projection or hollow, the working position of the other end of the spring plate is changed.

An advantage of the present invention with respect to the prior art is that the relative position of the rotatable block and the plate is changed by rotation of the rotatable shaft so that the first electrolinking point is electrically connected to or disconnected from the second electrolinking point thereby obtaining the function of a switch for controlling range of movement and applicable for limiting a linear range of movement rotationally.

In a preferred embodiment, the circumferential edge of the rotatable block forms a depressed cutout and the middle portion of the spring plate forms a projection substantially conforming with the depressed cutout so that during rotation of the rotatable shaft and rotatable block when the projection engages the depressed cutout the other end of the spring plate contacts the second electrolinking point and when the projection disengages the depressed cutout the other end of the spring plate disconnects from the second electrolinking point.

In a preferred embodiment, the plate comprises an upper worm wheel disposed coaxially with a lower worm wheel which respectively engage an upper worm gear rotationally disposed on the base and a lower worm gear rotationally disposed on the base. Since these portions of the plate are arranged together, the switch is readily adjusted.

DETAILED DESCRIPTION OF THE INVENTION

In the Figures is illustrated a switch for controlling the range of movement of (for example) a garage door which comprises a plate and a rotatable block 7. A rotatable shaft 4 is fixed at the central axis of the rotatable block 7 and is rotatably connected to the plate whilst being seated in a sliding bearing 17 in a base 1 to permit rotation. The rotatable shaft 4 and rotatable block 7 are driven simultaneously by a drive mechanism (not shown) during opening and closing of a garage door.

Figure 1:
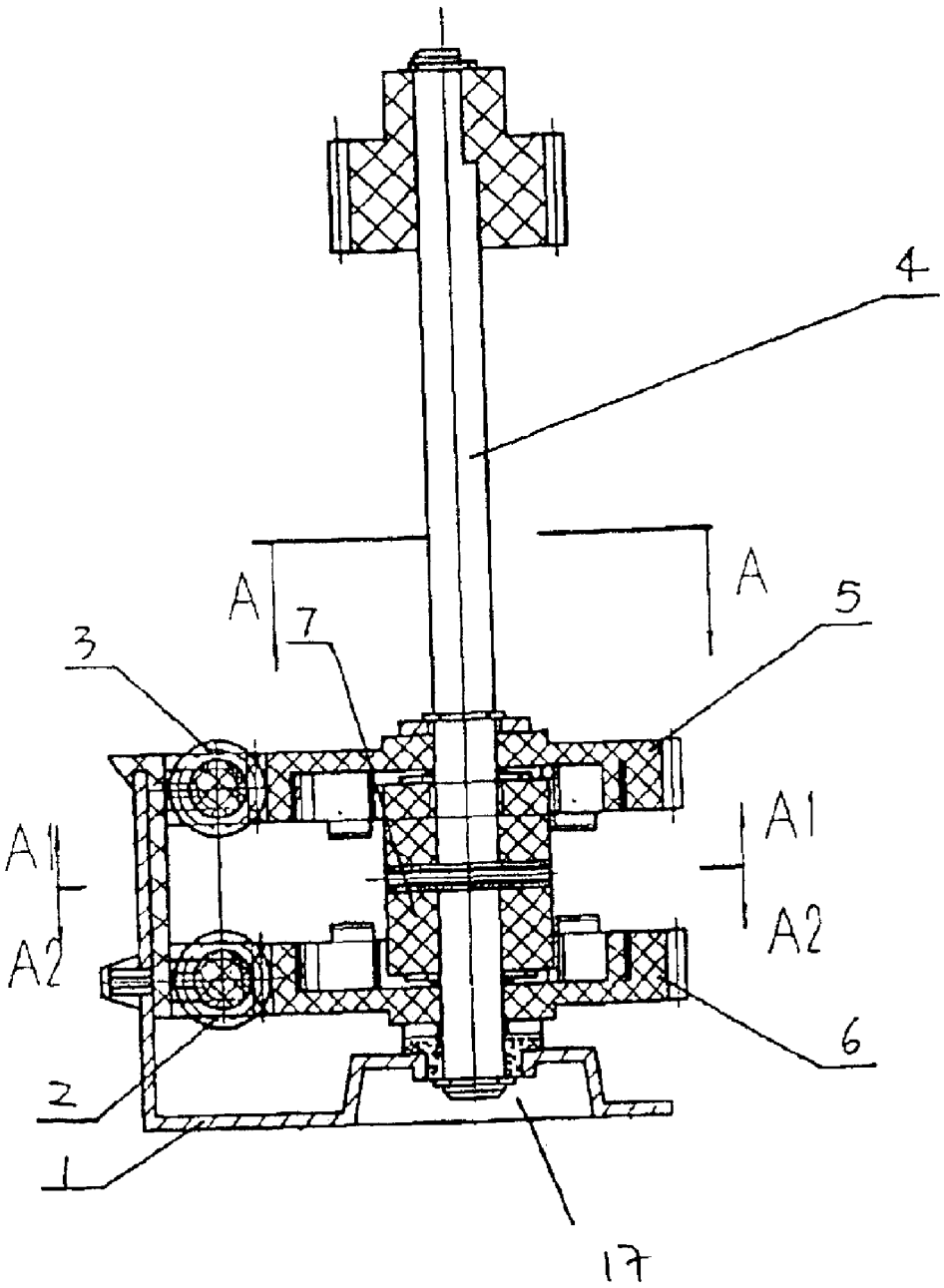
FIG. 1 is a main cross-sectional view of an embodiment of the present invention.
Figure 2:
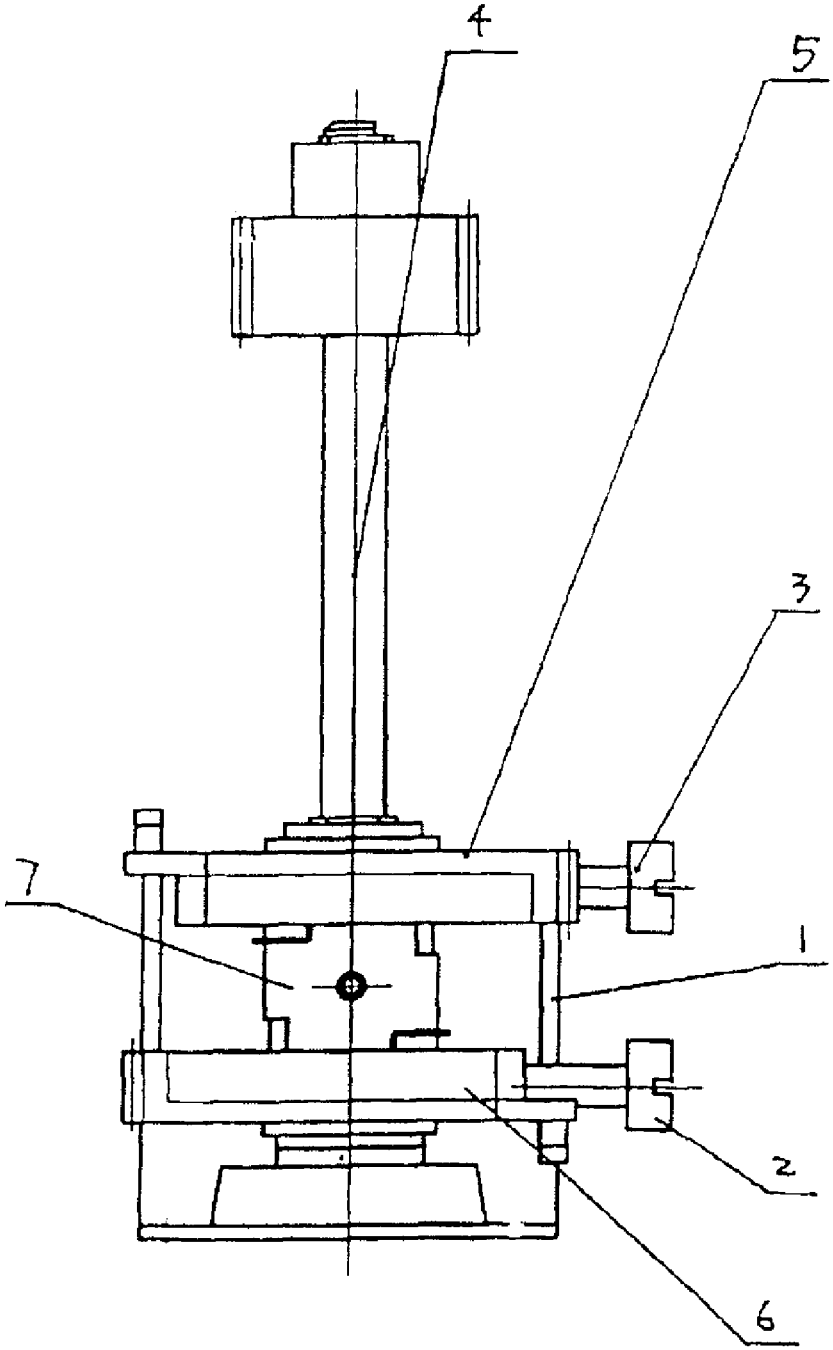
FIG. 2 is a right view of the embodiment of the present invention.
Figure 3:
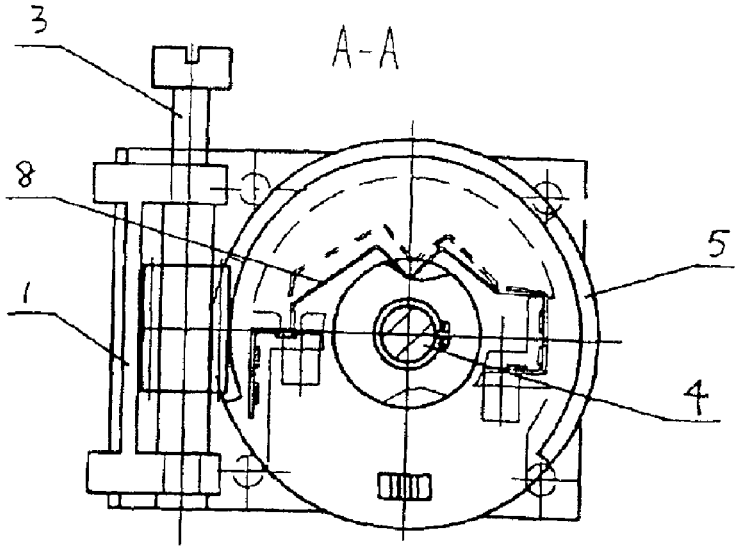
FIG. 3 is a cross-sectional view taken along line A—A of FIG. 1.
Figure 4:
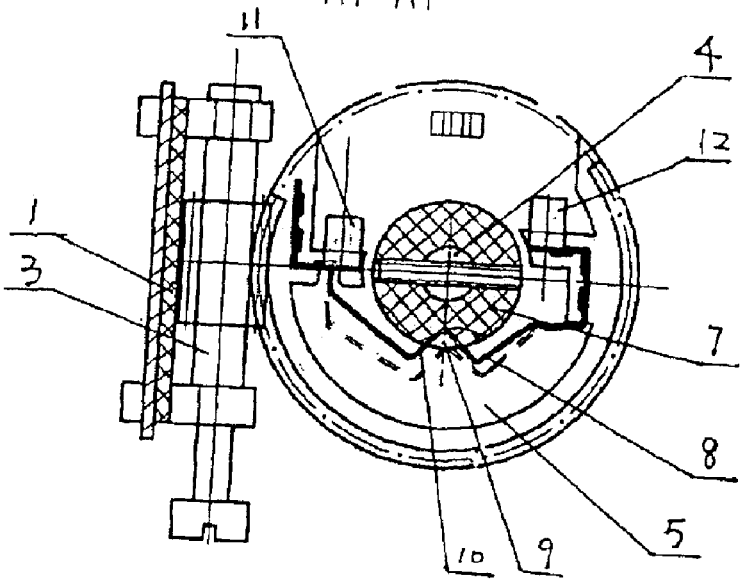
FIG. 4 is a cross-sectional view taken along line A1—A1 of FIG. 1.
Figure 5:
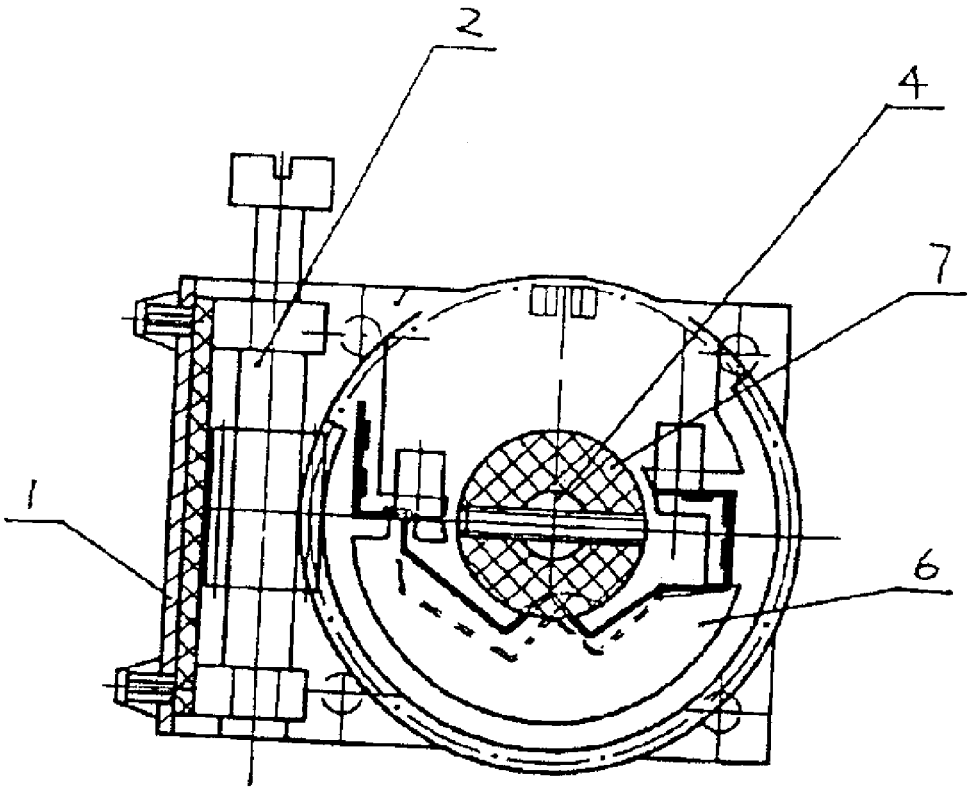
FIG. 5 is a cross-sectional view taken along line A2—A2 of FIG. 1.

The plate comprises an upper worm wheel 5 disposed coaxially with a lower worm wheel 6 which respectively engage an upper worm gear 3 and a lower worm gear 2 secured to the base 1. Each of the upper worm wheel 5 and lower worm wheel 6 fixes a first electrolinking point 11 (see FIG. 4) and a second electrolinking point 12 which are mutually spaced apart. A first end of a spring plate 8 is fixed and electrically connected to the electrolinking point 11. A second end of the spring plate 8 has two working positions with respect to the electrolinking point 12. In a first working position, the second end of the spring plate 8 contacts the electrolinking point 12 and in a second working position the second end of the spring plate 8 disconnects from the electrolinking point 12.

The middle portion of the spring plate 8 is generally abutted against a circumferential edge of the rotatable block 7. The circumferential edge of the rotatable block 7 has a depressed cutout 9 shown in FIG. 4 and the middle portion of the spring plate 8 is a projection 10 substantially conforming with the depressed cutout 9. As the middle portion of the spring plate 8 engages/disengages the depressed cutout 9 of the stationary plate during rotation of the rotatable block 7, the working position of the second end of the spring plate 8 is changed. In other words, when the projection 10 of the middle portion of the spring plate 8 engages with the depressed cutout 9, the second end of the spring plate 8 contacts the electrolinking point 12 and a signal is sent to a processor to indicate that the garage door has reached its limiting position (fully open or closed) and the motor is stopped. As the rotatable block 7 counter rotates relative to the stationary plate, the outer circumference of the rotatable block 7 pushes the spring plate 8 out so that the second end of the spring plate 8 disconnects from the second electrolinking point 12.

By adjusting the positions of engagement of the upper worm gear 3 with the upper worm wheel 5 and/or the lower worm gear 2 with the lower worm wheel 6, the distance between the projection 10 and the depressed cutout 9 is changed thereby changing the range of movement defined by the switch. In other words, the two limiting position (ie fully open and closed) of the switch may be conveniently and independently adjusted by the upper worm gear 3/upper worm wheel 5 and the lower worm gear 2/lower worm wheel 6 respectively. This makes the switch versatile in the sense that it may be used with garage doors of different heights.

The entire disclosure of Chinese Patent Application No. 02264324.9 filed Sep. 10, 2002 is incorporated by reference.

What is claimed is:

1. A garage door opener for driving a garage door between an open and a closed position comprising:

a motor for driving the garage door between the open and the closed position;

a drive mechanism responsive to the driving of the garage door;

a switch comprising:

a plate securing in spaced apart relationship a first electrolinking point and a second electrolinking point, the plate including a spring plate which comprises a first end, a middle portion and a second end;

a rotatable block rotationally supported relative to the plate, wherein the rotatable block has a projection or hollow; and a rotatable shaft rotationally driven by the drive mechanism during driving of the garage door, wherein the rotatable shaft is fixed to the rotatable block, wherein the first end of the spring plate is fixed to the first electrolinking point, the middle portion of the spring plate abuts the rotatable block and during rotation of the rotatable block when the middle portion of the spring plate moves out of contact with the radial projection or hollow, the second end of the spring plate moves out of contact with the second electrolinking point and when the middle portion of the spring plate moves into contact with the radial projection or hollow, the second end of the spring plate moves into contact with the second electrolinking point, wherein in use when the second end of the spring plate moves into contact with the second electrolinking point, the driving of the garage door is ceased.

2. The opener as claimed in claim 1, further comprising an upper worm gear and a lower worn gear both rotationally supported relative to the plate.

3. The opener as claimed in claim 1, wherein the plate further comprises an upper worm wheel and a lower worm wheel disposed coaxially with the upper worm wheel, the upper and lower worm wheels respectively engaging the upper and lower worm gears.

4. A switch for controlling a range of movement comprising:

a base;

a plate including a worm wheel engaged with a worm gear rotationally supported on the base, the plate securing a first electrolinking point and a second electrolinking point which are spaced apart;

a rotatable shaft rotationally supported on the base and rotatably connected to the plate;

a rotatable block fixedly connected to the rotatable shaft and having a first member;

a spring plate fixed to the plate, a first end of the spring plate being fixed to the first electrolinking point, the spring plate forming a second member engageable with the first member of the rotatable block and a second end of the spring plate being capable of adopting a first working position and a second working position with respect to the second electrolinking point, wherein in the first working position, the second end of the spring plate is in contact with the second electrolinking point and in the second working position, the second end of the spring plate is out of contact with the second electrolinking point, wherein during rotation of the rotatable block, when the second member of the spring plate moves out of contact with the first member of the rotatable block, the second end of the spring plate changes from the first working position to the second working position and when the second member of the spring plate moves into contact with the first member, the second end of the spring plate changes from the second working position to the first working position.

5. The switch as claimed in claim 4, wherein the first member of the rotatable block is a depressed cutout and the second member of the spring plate is a projection substantially conforming with the depressed cutout so that during rotation of the rotatable block, when the projection engages the depressed cutout, the second end of the spring plate contacts the second electrolinking point, and when the projection disengages the depressed cutout, the second end of the spring plate disconnects from the second electrolinking point.

6. A switch for controlling a range of movement comprising:

a base;

a plate including an upper worm wheel and a lower worm wheel disposed coaxially with the upper worm wheel, the upper and the lower worm wheels respectively engaging an upper worm gear rotationally supported on the base and a lower worm gear rotationally supported on the base, the plate securing a first electrolinking point and a second electrolinking point which are spaced apart;

a rotatable block having a first member;

a spring plate fixed to the plate, a first end of the spring plate being fixed to the first electrolinking point, the spring plate forming a second member engageable with the first member of the rotatable block and a second end of the spring plate being capable of adopting a first working position and a second working position with respect to the second electrolinking point, wherein in the first working position, the second end of the spring plate is in contact with the second electrolinking point and in the second working position, the second end of the spring plate is out of contact with the second electrolinking point, wherein during rotation of the rotatable block, when the second member of the spring plate moves out of contact with the first member of the rotatable block, the second end of the spring plate changes from the first working position to the second working position and when the second member of the spring plate moves into contact with the first member, the second end of the spring plate changes from the second working position to the first working position.

7. The switch as claimed in claim 6, further comprising a rotatable shaft fixedly connected to the rotatable block.

8. The switch as claimed in claim 7, wherein the rotatable shaft is rotationally supported on the base.

9. A switch for controlling range of movement, comprising:

a base;

a plate having a first electrolinking point and a second electrolinking point;

a spring plate fixed to the plate, the spring plate forming a first member and a first end of the spring plate fixed to the first electrolinking point and a second end of the spring plate is capable of adopting a first working position and a second working position with respect to the second electrolinking point;

a rotatable block rotatable relative to the plate and forming a second member engageable with the first member of the spring plate; and a rotatable device including an upper worm gear and a lower worm gear both rotationally supported on the base, the rotatable device is engaged with the plate to make the plate rotate relative to the block, wherein in the first working position, the second end of the spring plate is in contact with the second electrolinking point and in the second working position, the second end of the spring plate is out of contact with the second electrolinking point, wherein during rotation of the rotatable block, when the second member of the spring plate moves out of contact with the first member of the rotatable block, the second end of the spring plate changes from the first working position to the second working position, and when the second member of the spring plate moves into contact with the first member, the second end of the spring plate changes from the second working position to the first working position.

10. The switch as claimed in claim 9, wherein the plate comprises an upper worm wheel and a lower worm wheel disposed coaxially with the upper worm wheel, the upper and the lower worm wheels respectively engaging an upper worm gear and a lower worm gear of the rotatable device.

11. The switch as claimed in claim 9, wherein the first member of the rotatable block is a depressed cutout and the second member of the spring plate is a projection substantially conforming with the depressed cutout so that during rotation of the rotatable block, when the projection engages the depressed cutout, the second end of the spring plate contacts the second electrolinking point, and when the projection disengages the depressed cutout, the second end of the spring plate disconnects from the second electrolinking point.

12. The switch as claimed in claim 9, further comprising a rotatable shaft fixedly connected to the rotatable block and rotationally supported on the base.

* * * * *